US006546702B1

(12) United States Patent
Pickett

(10) Patent No.: US 6,546,702 B1
(45) Date of Patent: Apr. 15, 2003

(54) METHOD AND APPARATUS FOR PREPARATION OF CAPSULE WITH IMPROVED CLOSING/EJECTION PINS

(75) Inventor: Wesley Wayne Pickett, Gaffney, SC (US)

(73) Assignee: Nutricia Manufacturing U.S.A., Inc., Greenville, SC (US)

( * ) Notice: Subject to any disclaimer, the term of this patent is extended or adjusted under 35 U.S.C. 154(b) by 0 days.

(21) Appl. No.: 10/016,293

(22) Filed: Oct. 30, 2001

Related U.S. Application Data

(63) Continuation of application No. 09/822,382, filed on Mar. 30, 2001, now abandoned.

(51) Int. Cl.[7] ..... B65B 7/00
(52) U.S. Cl. ..... 53/485; 53/281; 53/286
(58) Field of Search ..... 53/281, 286, 341, 53/342, 359, 361, 485, 390, 900, 287, 471

(56) References Cited

U.S. PATENT DOCUMENTS 3,070,932 A * 1/1963 Hofliger ..... 53/281
3,078,629 A * 2/1963 Besemer et al. ..... 53/281
3,538,677 A * 11/1970 Amoroso et al. ..... 53/299
3,552,095 A * 1/1971 Inman ..... 141/247
5,032,074 A 7/1991 Muto et al.
5,698,155 A 12/1997 Grosswald et al.
5,750,157 A 5/1998 Grosswald et al.
5,756,036 A 5/1998 Grosswald et al.
5,993,185 A 11/1999 Furr
6,000,928 A 12/1999 Victorov et al.
6,170,226 B1 * 1/2001 Chang ..... 53/64

* cited by examiner

*Primary Examiner*—Scott A. Smith
*Assistant Examiner*—Nathaniel Chukwurah
(74) *Attorney, Agent, or Firm*—Reed Smith LLP

(57) ABSTRACT

The present invention is directed to devices for encapsulating medicinal products and methods of using these devices to form the encapsulated product. More specifically, the present invention includes improved closing and/or ejection pins for use with a conventional capsule closing device. The closing pins may be hollow down a longitudinal interior diameter and may include a chamfered capsule contacting surface. The closing and/or ejection pins may be removably mounted to a pin plate and may be manufactured from a polymer. The pin plate may be attached to an actuation shaft in a non-rotational fashion, such as with a non-circular shaft profile and set screw.

20 Claims, 8 Drawing Sheets

METHOD AND APPARATUS FOR PREPARATION OF CAPSULE WITH IMPROVED CLOSING/EJECTION PINS

This application claims continuing status from application Ser. No. 09/822,382 filed Mar. 30, 2001, now abandoned.

FIELD OF THE INVENTION

The present invention generally relates to methods and devices for preparing medicinal capsules and more specifically to medicinal capsule preparation methods and devices with improved closing and ejection pins.

BACKGROUND OF THE INVENTION

The mass production of medicines, supplements, and other compounds in predefined doses has become an important part of the health care and exercise industries. Many of these doses come prepackaged inside a two-piece, hard gelatin or cellulose capsule. Such a capsule may be easier to administer to a patient when compared to other forms of doses, and the capsules may be more readily produced by a mass production manufacturing facility.

The conventional process for the production of a medicinal capsule involves putting the two empty halves of the capsule in a pressing rack, filling the lower capsule half with powdered or some other form of medicine, and pressing or squeezing the two capsule halves together until they are frictionally locked. The current devices for holding and pressing these capsule halves together may suffer from various undesirable problems.

SUMMARY OF THE INVENTION

The present invention broadly contemplates, in at least one presently preferred embodiment, a method and apparatus for packaging a measured dose of a medicinal or other material in a container. More specifically, one embodiment of the present invention includes a device for squeezing two halves of a medicinal capsule together and ejecting the capsule from the capsule preparation device.

In a preferred embodiment of the present invention, the capsule production device may include one or more hollow closing pins that may be used to press the two halves of the capsule together into frictional contact with each other. The closing pins may be removably secured to a pin plate and may be chamfered at the capsule end to reduce the local force on any one area of the capsule to be squeezed.

In a preferred embodiment of the present invention, a pin plate that holds one or more closing and/or ejection pins may be mounted to an actuating shaft that is capable of forcing the pins into contact with the capsules to be formed along a vertical axis through the center of the capsules. The pin plate and shaft may have matching non-rotational profiles so that a horizontal force on the device may not produce a twisting, bending, or slipping of the pin plate in relation to its rotational position in the actuating shaft. The pin plate may be secured to the actuating shaft by way of a set screw inserted through the upper portion of the actuating shaft.

These and other details, objects, and advantages of the present invention will be more readily apparent from the following description of the presently preferred embodiments.

BRIEF DESCRIPTION OF THE DRAWINGS

The present invention and its presently preferred embodiments will be better understood by reference to the detailed disclosure hereinafter and to the accompanying drawings, wherein.

DESCRIPTION OF THE PREFERRED EMBODIMENTS

Figure 1:
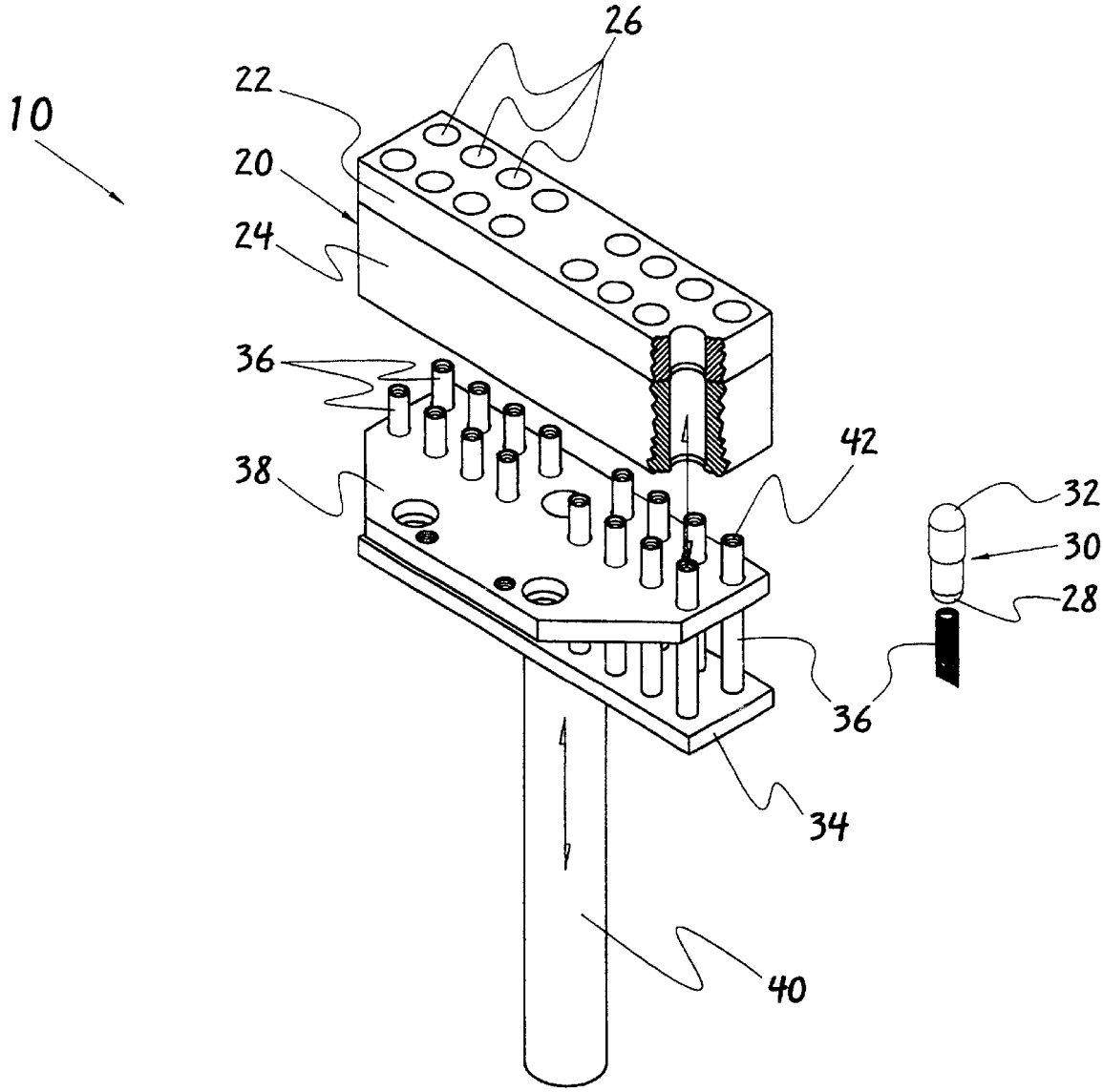
FIGURE 1 (PRIOR ART)
FIG. 1 is an isometric view of a prior art capsule closing device.

As stated briefly above, a conventional mass production method of closing a capsule or other container for a powdered or other medication includes pressing the two halves of the capsule together with a machine 10 as partially shown in FIG. 1. The two-piece segment 20 of the conventional capsule closing machine 10 includes an upper segment 22 and a lower segment 24 that provide a plurality of vertical holes or slots 26 (sixteen shown in FIG. 1) in which the two halves 28, 32 of the capsule 30 are brought together.

A plurality of empty capsule tops 32 may be inserted into the upper segment 22 with the open end of these tops 32 facing downwards. These tops 32 may be held in place in the upper segment 22 by a stepped shoulder. Simultaneously, a plurality of lower capsule halves 28 of the capsules 30 may be inserted into the lower segment 24 with the open ends of the capsule halves facing up (toward the upper capsule half). The lower capsule halves 28 are supported in place in the lower segment 24 by a shelf or ledge at the bottom of the lower segment 24. Both the top of the upper segment 22 and the bottom of the lower segment 24 should have shafts or openings 26 to enable the closing and ejection pins to operate on the capsules 30 therewithin.

The upper 22 and lower 24 segments may then be brought together so that the vertical slots 26 in the upper and lower segments align. This two-piece segment 20 is then preferably brought to the rest of a capsule closing and ejection machine 10. The conventional capsule closing machine 10 generally includes a pin plate 34 which is a broad flat plate that holds a plurality of closing pins 36. The pin plate 34 is preferably bolted (via a vertical bolt not shown) to the top of a cylindrical closing pin actuating shaft 40 that compresses the lower capsule half 28 into the upper capsule half 32. This shaft 40 is connected to an actuating device (not shown) that is capable of moving the shaft along a vertical line. Attached to the top face of the pin plate 34 is a plurality of closing pins 36 arranged to match the plurality of slots 26 in the two-piece segment 20. These closing pins 36 may be solid cylinders with a spherical concave depression in the top 42. These conventional closing pins 36 are bolted to the upper face of the pin plate 34 and extend generally upwards toward the two-piece segment 20.

Because the closing pins 36 may not accurately line up with the slots or holes 26 in the two-piece segment 20 and because the pins may bend through use, there may also be a stationary guide plate 38 that surrounds the middle of the extending closing pin shafts 36 to align them with the holes 26 in the lower segment 24 of the two-piece segment 20. This stationary guide plate 38 preferably is attached to some external point of reference (e.g., the remainder of the capsule closing machine 10) so that the closing pins 36 may travel up into the two piece segment 20 guided by the stationary guide plate 38, without the guide plate 38 moving in the vertical direction. The holes in the stationary guide plate 38 are preferably of a slightly larger diameter than the closing pins 42 to allow the pins to slide through these holes along a vertical line. Finally, a counter closing device (not shown) is preferably located above the top of the upper segment 22 of the two-piece segment 20 to prevent the tops of the capsules 30 from popping out of the segment 20 during capsule 30 compression.

Once aligned, the closing pin actuating shaft 40 is actuated (by the actuating device), and the shaft 40 forces the pin plate 34, and therefore the closing pins 36, up into the holes 26 of the two-piece segment 20 (which holds the two capsule halves 28, 32 therewithin). The lower half 28 of the capsule is forced up and into or around the upper half 32 of the capsule. Because the counter closing device (which may be merely a flat piece of material covering the segment shafts or holes 26) restricts movement of the capsule tops 32 in the vertical direction, the two halves 28, 32 of the capsule are squeezed together to a predetermined point where the two halves 28, 32 frictionally lock together.

After the plurality of capsules 30 are locked together, the closing pin actuating shaft 40 is pulled downward and the closing pins 36 are pulled out from the two-piece segment 20 (guided by the stationary guide plate 38). Also, the counter closing device is removed so that the two-piece segment 20 is left with the completed capsules 30 within the slots 26 of the two-piece segment 20. Next, an ejection pin device (not shown) is preferably actuated. The ejection pin device is similar to the closing pin device, except the ejection pins are preferably longer and of a smaller diameter than the closing pins 36. When the ejection pin device is actuated, the ejection pins enter the hole or slots 26 of the two piece segment 20 and force (or "eject") the completed capsules 30 through the top of the two piece segment 20. Once the ejection pins eject the completed capsules 30, the process may preferably begin again.

Figure 2:
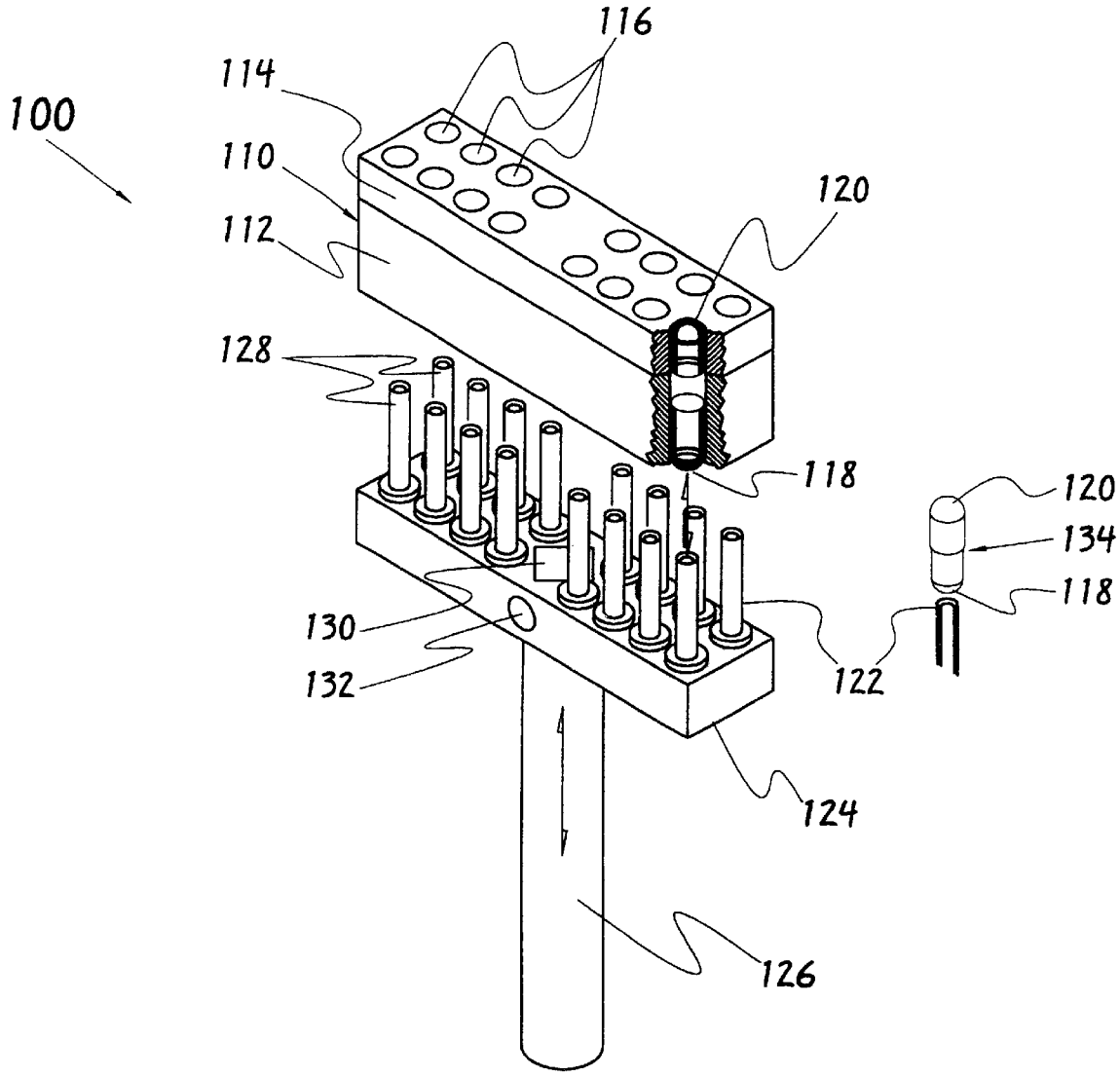
FIG. 2 is an isometric view of a capsule closing device according to one aspect of the present invention.

FIG. 2 shows part of one presently preferred embodiment of an improved device 100 for automatically closing a series of filled capsules 134 or other devices as envisioned by the present invention. The two-piece capsule segment 110 may be similar to that of the conventional model described above. Preferably, the two-piece segment 110 includes an upper segment 114 which houses an empty upper half 120 of a capsule 134 and a lower segment 112 which houses the lower half 118 of the capsule 134. In practice, the upper capsule half 120 may be held in place in the upper segment 114 by a stepped shoulder. The lower capsule half 118 may be placed into the lower segment 112 where it is supported in place by a ledge at the bottom of the lower segment 112 that has a slightly smaller diameter than the capsule bottom 118 resting in the lower segment 112.

At this point, a predetermined amount of powdered product or other material is then preferably injected into the lower capsule half 118. The upper 114 and lower 112 segments may then preferably be brought together so that the upper 120 and lower 118 capsule halves line up in the vertical direction. The slots or holes 116 in the two piece segment 110 run therethrough in a vertical direction. This two-piece segment 110 is then preferably brought to the rest of a capsule closing and ejection machine 100.

In the FIG. 2 embodiment, the pin plate 124 is shown with sixteen vertically extending closing pins 122 (matching the sixteen holes 116 in the two piece upper segment 110) and an actuating shaft 126. In this embodiment, the upper section 130 of the actuating shaft has a square profile. The pin plate 124 may have a corresponding acceptance profile (in this case a square slot). This square or other non-rotational profile 130 may be useful in preventing the pin plate 124 (and therefore the closing pins 122 themselves) from becoming rotationally misaligned from the capsule slots or holes 116 in the two-piece capsule segment 110. If the closing pins 122 do not line up, they may bend or break when the closing pin actuating shaft 126 is actuated which may cause a loss of time or money during the manufacturing process. Also, the pin plate 124 and the actuating shaft 126 may be secured to each other by a bolt or screw 132 that extends through the upper portion 130 of the actuating shaft 126. This horizontal screw 132 will also preferably impede any rotational movement of the pin plate 124, even if the screw 132 becomes loosened.

The closing pins 122 are preferably inserted into the pin plate 124 by applying pressure rather than by bolting the pins 122 to the plate 124. To aid in this pressure fit, the pins 122 may preferably be made from a polymer material such as an FDA approved polymer. By changing the pin 122 material from the conventional stainless steel to such a polymer, there may be a reduced cost in the manufacture of the closing pins 122. Also, by making the pins 122 pressure-fitted to the pin plate 124 rather than bolted, the pins 122 may be more quickly and easily replaced when some sort of pin failure occurs during device 100 operation.

Additionally, the closing pins 122 may have a hollow hole drilled all the way through the elongated shaft (along the vertical axis in FIG. 2). Upon actuation, when the closing pins 122 force the lower capsule half 118 into or around the upper capsule half 120, some product may overflow from the capsules 134. With the conventional, spherical depression-tipped closing pins 36, some of this material may collect in the tips 42 of the closing pins 36. Upon shaft 40 actuation in a subsequent capsule closing process, this collected excess product may cause an indentation or deformation in the bottom of the newly closed capsule. This deformation may render the capsule a failure and not sellable to the public.

With the hollow closing pins 122 of at least one embodiment of the present invention, the excess product that spills during capsule 134 closure may preferably pass right through the hollow middle hole of the closing pin 122 and pass harmlessly away from the next capsule run. Such a hole may lessen the amount of capsule 134 failures during the process cycle. Also, there may be a 120 degree (or other dimension) chamfer cut into the top 128 of the closing pin 122 (the face that contacts the capsule 134). This chamfer may be preferred to a flat edge because it distributes the actuating force to the outside or "shoulder" area of the capsule 134 rather than concentrating the force in any one place (especially at the tip of the capsule). This force-spreading may again reduce the number of capsule failures due to deformed or broken capsules during actuation and capsule closing.

Figure 3:
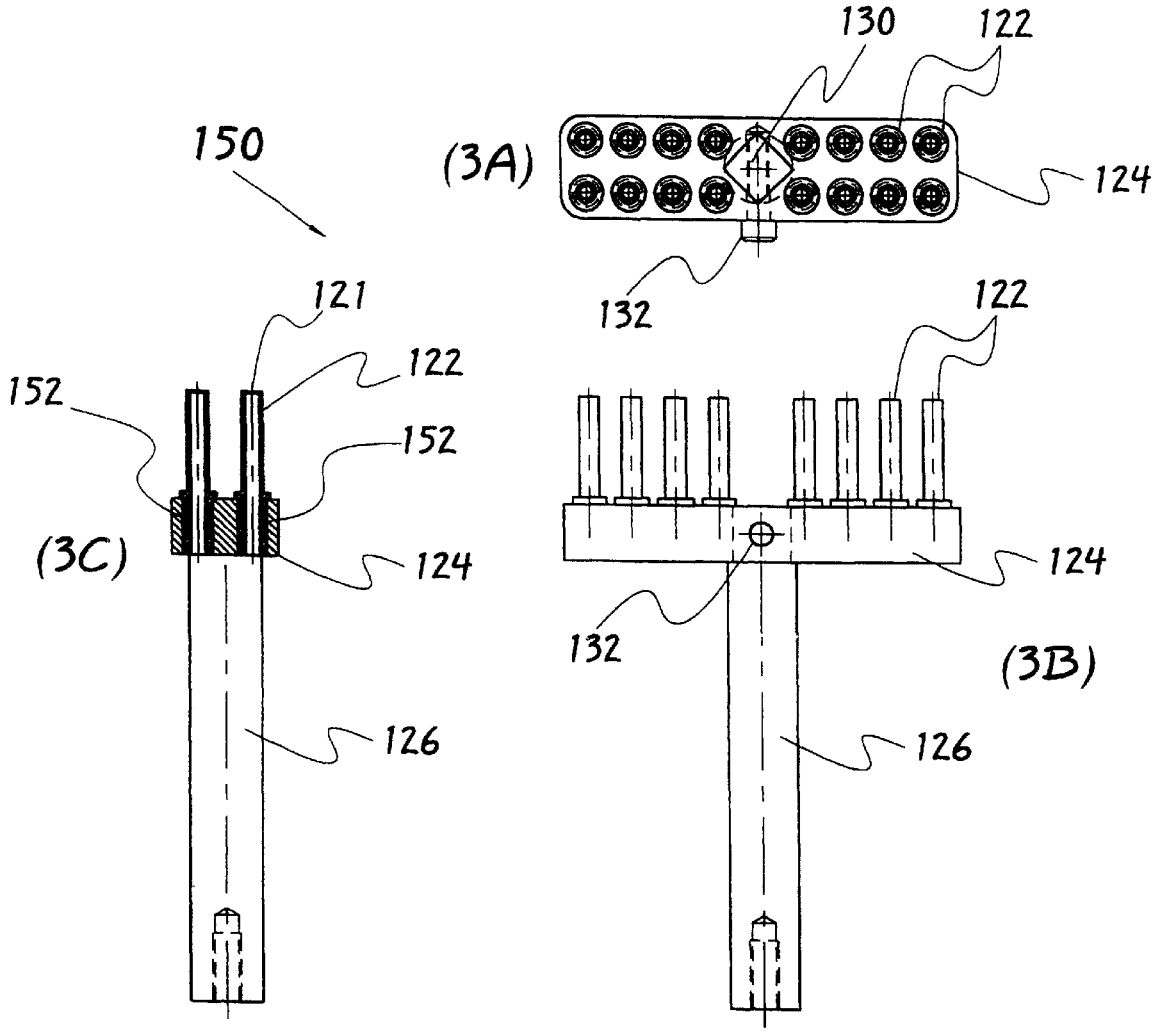
FIGS. 3A–3C show an enlarged top (3A), front (3B), and side (3C) view of a pin plate, closing pin, and actuating shaft combination.

FIGS. 3A–3C show an enlarged top (3A), front (3B), and side (3C) view of the pin plate 124, closing pin 122, and actuating shaft 126 combination 150. The top view details the non-rotational square profile 130 of the top portion of the actuating shaft 126 and the corresponding acceptance slot of the pin plate 124. A set screw 132 is then preferably used in the horizontal plane to secure the pin plate 124 to the actuating shaft 126. FIG. 3C also shows how the closing pins are preferably pressed (at 152) rather than bolted into the pin plate 124. Here, the base of each closing pin 122 contains an increased diameter insertion shaft that mates with a hole drilled in the pin plate 124. Also, FIG. 3C shows the hollow hole or slot 121 drilled vertically through the elongated axis of the closing pin to allow excess product to pass therethrough during device 100 operation.

Figure 4:
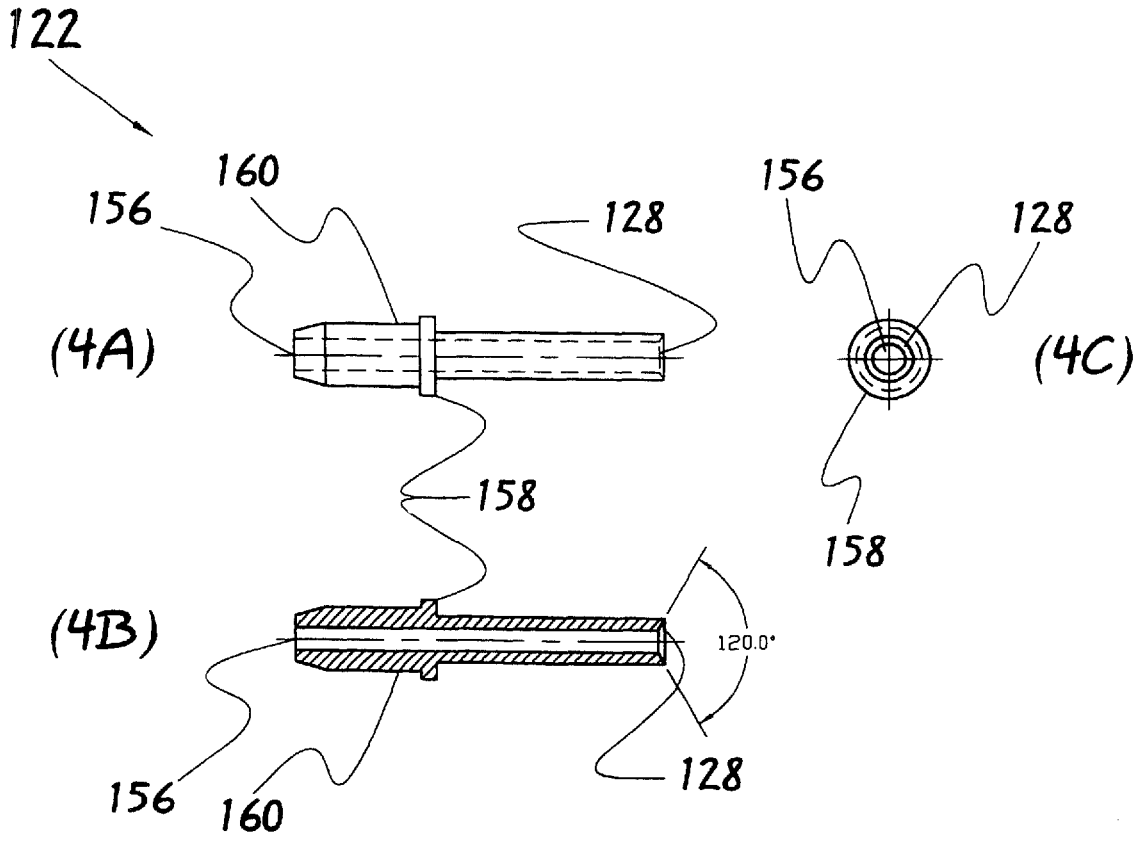
FIGS. 4A–4C show an enlarged top (4A), front (4B), and side (4C) view of a presently preferred closing pin for use with the present invention.

FIGS. 4A–4C show an enlarged side (4A), cross section (4B), and top (4C) view of a presently preferred closing pin 122 for use with the present invention. The 120 degree chamfer at the end 128 of the closing pin 122 that contacts the capsule 134 may be useful in distributing the force of the compression more evenly over the lower capsule halfs 118 surface area. The pin plate insertion side of the closing pin 122 includes an insertion shaft 160 to be pressed into the pin plate 124 and an insertion ledge or shoulder 158 to prevent the closing pin 122 from being inserted into the pin plate 124 too far. This ledge 158 may also keep the chamfered tip 128 of the closing pin 122 at the correct desired height throughout device 100 operation. The hollow shaft 156 is also depicted.

Figure 5:
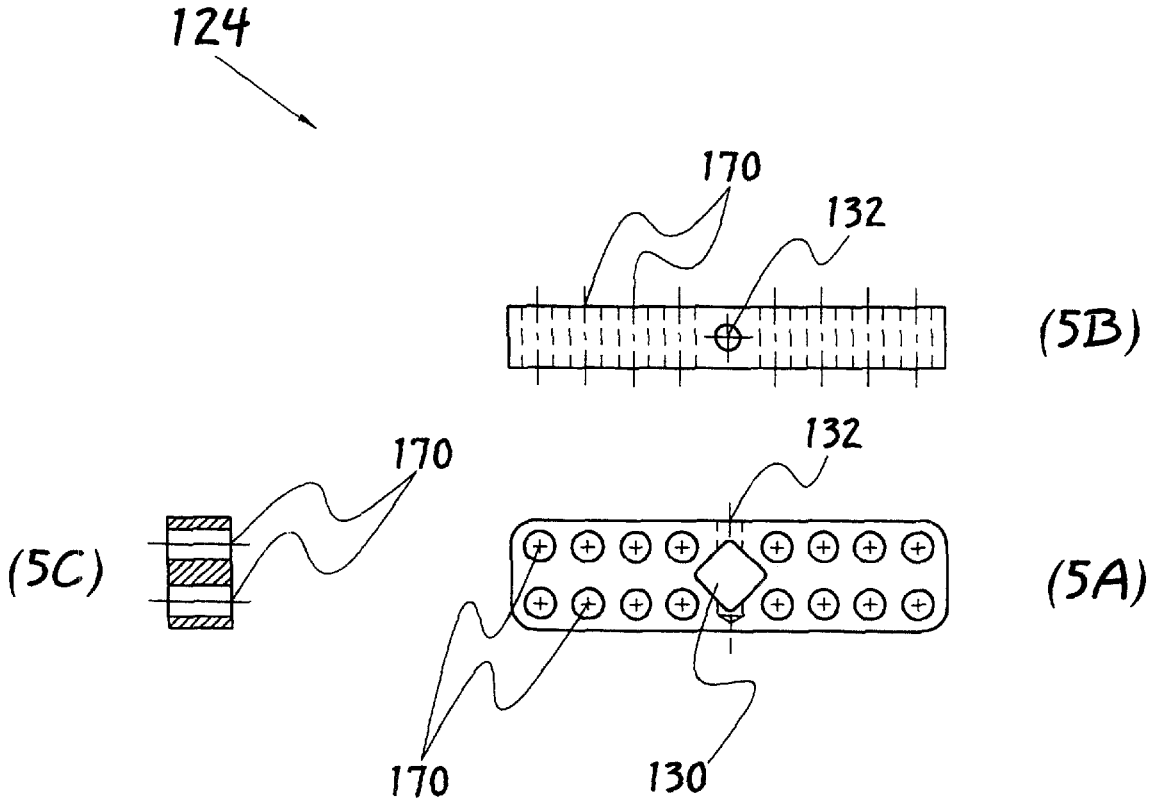
FIGS. 5A–5C show an enlarged top (5A), front (5B), and side (5C) view of a presently preferred closing pin plate for use with the present invention.

FIGS. 5A–5C show an enlarged top (5A), front (5B), and side section (5C) view of a presently preferred closing pin plate 124 for use with the present invention. The non-rotational shape of the actuating shaft acceptor 130 may be seen here. The slot for set screw 132 is showing in FIGS. 5A–5B. Also, preferred positions of the slots or holes 170 that accept the insertion shaft 160 of the closing pins 122 are detailed.

Figure 6:
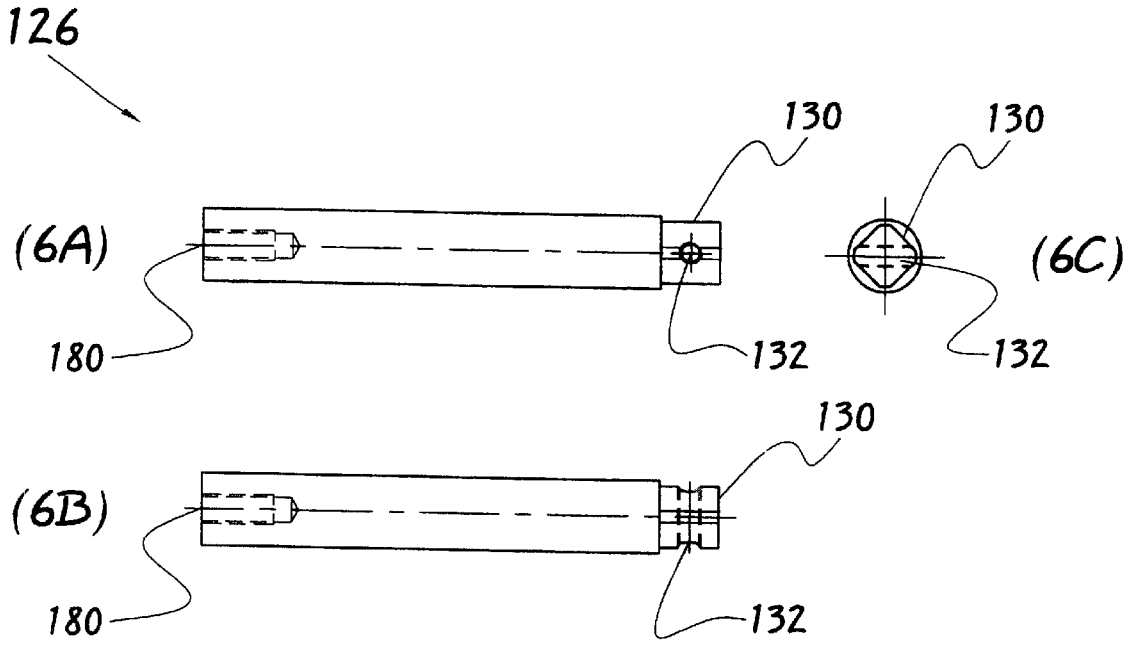
FIGS. 6A–6C show a top (6A), front (6B), and side (6C) view of one presently preferred actuating shaft for use with the present invention.

FIGS. 6A–6C show a front (6A), side (6B), and top (6C) view of one presently preferred actuating shaft 126 for use with the present invention. These figures detail how the set screw 132 passes through the non-rotational upper shaft portion 130 to secure the pin plate 124 to the shaft 126. There is also shown a tap 180 in the opposite end of the actuating shaft 126 to secure the shaft 126 to an actuation device (not shown). The tap 180 may facilitate replacement or removal of the shaft 126 during device operation.

As the actuating shaft 126 pushes upward toward the two-piece capsule segment 110, the upper ends 128 of the closing pins 122 enter the lower part of the slots 116 through the two-piece capsule segment 110. As the closing pins 122 push upward, the lower capsule half 118 filled with product is forced into and/or around the empty upper half 120 of the capsule 134 until a predetermined closing point is reached. The counter closing device again restricts the upper capsule halves 120 from escaping the two-piece segment 110 in the vertical direction. At this closing point, the upper 120 and lower 118 capsule halves have been secured together by friction, and the capsule 134 is now one complete capsule. At this point, the actuating shaft 126 preferably is retracted down so the closing pins 122 lower out of the upper capsule segment 114 and away from the capsules 134. The closed capsules 134 remain in the two-piece capsule segment 110.

Figure 7:
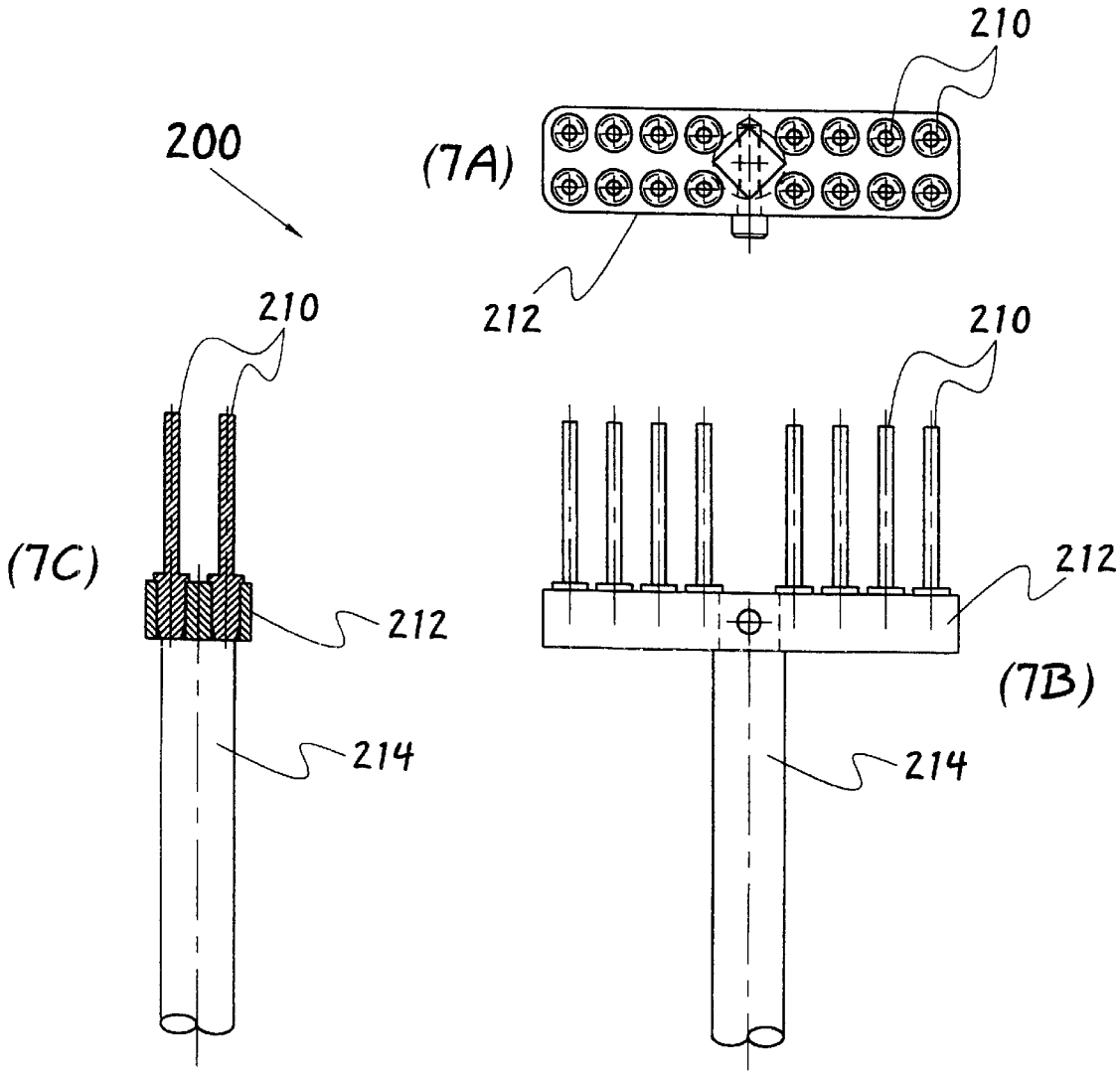
FIGS. 7A–7C show a top (7A), front (7B), and side (7C) view of one presently preferred ejection pin actuation device.

To force the closed capsules 134 out of the two-piece upper capsule segment 110, a device similar to the closing pins 122 is preferably used. FIGS. 7A–7C show a top (7A), front (7B), and side (7C) view of one such device. This device 200, utilizing ejection pins, includes one or more ejection pins 210 which are preferably a series of solid pins 210 that are pressure mounted to an ejection pin plate 212 and an ejection pin actuating shaft 214 (which could be the same as the closing pin plate 124 and closing pin shaft 126). The ejection pins 210 may differ from the closing pins 122 because they are preferably meant to force the closed capsules 134 out of the two-piece segment 110 rather than forcing the two halves 118, 120 of the capsule 134 together. Hence, the ejection pins 210 are preferably longer than the closing pins and do not preferably include a chamfered tip. Before actuation of the ejection pin actuating shaft 214, the counter closing device is preferably removed from being in contact with the two-piece segment 110. This removal may leave the upper end of the holes or slots 116 of the two-piece segment 110 open so that the capsules 134 can exit through this top hole.

The ejection pins 210 are preferably lined up along the vertical axis through the center of the capsules 134 in the two-piece segment 110 (the same as the closing pins 122). Upon actuation, the ejection pins 210 are pushed up into the hollow channels 116 in the two-piece segment 110 (where the capsules 134 are currently held) and the ejection pins 210 come into contact with the lower portion of the lower capsule half 118. Upon increased actuation of the ejection pin actuator shaft 214, the ejection pins 210 preferably force the capsules 134 up and out of the top of the two-piece segment 110. In one preferred embodiment, the capsules 134, once ejected from the two-piece segment 110, may be removed from the vicinity of the two-piece segment 110 by compressed air.

Figure 8:
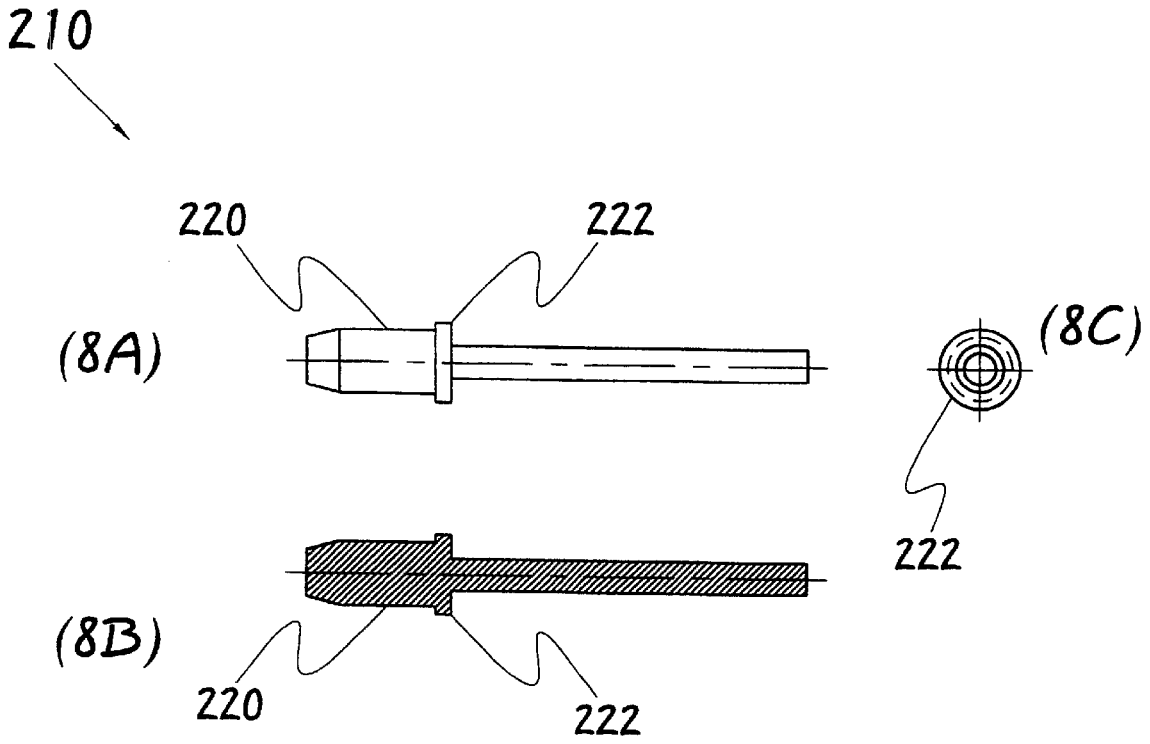
FIGS. 8A–8C show a top (8A), front (8B), and side (8C) view of one presently preferred ejection pin for use with the present invention.

To aid in this forcing, the ejection pins 210 may preferably be longer and narrower than the closing pins 122. FIGS. 8A–8C detail a front (8A), side section (8B), and top (8C) view of one presently preferred ejection pin 210 for use with the present invention. The ejection pins 210 may be secured to the ejection pin plate 212 by friction (through enlarged diameter lower section 220) rather than being bolted to the pin plate 212. Such a connection method may allow the closing pins to more easily be removed or replaced when necessary. There may also be an ejection pin ledge or shoulder 222 to prevent the ejection pins 210 from being inserted too deeply into the ejection pin plate 212 and to keep the ejection pins 210 at the proper height within the two-piece segment 110.

After the capsules 134 are ejected from the top of the two-piece segment 110 and collected, the now empty segment 110 is returned to the capsule loading station where the process can start over again. This may preferably complete one full cycle of use of the capsule preparation device 100.

The above specification describes several different embodiments and features of a capsule preparation device 100. Various parts, selections, and/or alternatives from the various embodiments may preferably be interchanged with other parts of different embodiments. Although the invention has been described above in terms of particular embodiments, one of ordinary skill in the art, in light of the teachings herein, can generate additional embodiments and modifications without departing from the spirit of, or exceeding the scope of, the claimed invention. Accordingly, it is to be understood that the drawings and the descriptions herein are proffered by way of example only to facilitate comprehension of the invention and should not be construed to limit the scope thereof.

What is claimed is:

1. An apparatus for closing capsules comprised of:

a capsule holding device;

a capsule pressing device including closing pins; and an actuation device to force the capsules closed, wherein said capsule holding device includes an actuation shaft with a non-rotational profile at one end and a pin plate with a matching non-rotational profile to accept insertion of the shaft into the plate.

2. The apparatus of claim 1, wherein said closing pins include a chamfered tip that contact the capsule during capsule closing.

3. The apparatus of claim 1, wherein said closing pins are hollow.

4. The apparatus of claim 1, wherein said shaft is held to said pin plate with a set screw.

5. The apparatus of claim 4, wherein an elongated shaft of said set screw is oriented in the horizontal direction.

6. The apparatus of claim 1, wherein said closing pins are removably mounted to a pin plate.

7. The apparatus of claim 6, wherein said closing pins are pressure fitted into corresponding slots in said pin plate.

8. The apparatus of claim 7, wherein said closing pins further include a shoulder to limit the insertion depth of said closing pins into said pin plate.

9. The apparatus of claim 1, wherein said closing pins are made of a polymer material.

10. The apparatus of claim 1, further including an ejection device including ejection pins.

11. The apparatus of claim 10, wherein said ejection pins are removably mounted to a pin plate.

12. The apparatus of claim 11, wherein said ejection pins are pressure fitted into corresponding slots in said pin plate.

13. The apparatus of claim 12, wherein said closing pins further include a shoulder to limit the insertion depth of said closing pins into said pin plate.

14. The apparatus of claim 10, wherein said closing pins are made of a polymer material.

15. An apparatus for closing capsules comprised of:

a capsule holding device;

a capsule pressing device including closing pins, wherein said closing pins are hollow; and an actuation device to force the capsules closed.

16. The apparatus of claim 15, wherein said closing pins include a chamfered tip that contacts the capsule during capsule closing.

17. The apparatus of claim 16, wherein said capsule pressing device further includes:

an actuation shaft with a non-rotational profile at one end; and a pin plate with a matching non-rotational profile to accept insertion of the shaft into the pin plate.

18. The apparatus of claim 15, wherein said capsule pressing device includes:

an actuation shaft with a non-rotational profile at one end; and a pin plate with a matching non-rotational profile to accept insertion of the shaft into the pin plate, wherein said closing pins are removably mounted to a pin plate.

19. An apparatus for closing capsules comprised of:

a capsule holding device;

a capsule pressing device including closing pins, wherein said closing pins include a chamfered tip that contacts the capsule during capsule closing; and an actuation device to force the capsules closed.

20. The apparatus of claim 19, wherein said closing pins further include a shoulder to limit the insertion depth of said closing pins in a pin plate.

* * * * *